US005788518A

United States Patent [19]

Wachter et al.

[11] Patent Number: 5,788,518

[45] Date of Patent: Aug. 4, 1998

[54] ADJUSTABLE CONNECTOR FOR TRACK LIGHTING FIXTURE

[75] Inventors: Peter F. Wachter, Northfield; Donald L. Kuball, Franklin Park, both of Ill.

[73] Assignee: Juno Lighting, Inc., Des Plaines, Ill.

[21] Appl. No.: 829,347

[22] Filed: Mar. 31, 1997

[51] Int. Cl.[6] ..... H01R 25/00

[52] U.S. Cl. ..... 439/121; 362/287

[58] Field of Search ..... 439/110–122; 362/286, 287

[56] References Cited

PUBLICATIONS

Juno trac–master catalog, published by Juno Lighting, Inc., copyrighted 1995. pp. 10, 12, 20, 24, 30, 34 and 48.

*Primary Examiner*—Neil Abrams
*Assistant Examiner*—Eugene G. Byrd
*Attorney, Agent, or Firm*—Anthony S. Zummer

[57] ABSTRACT

An adjustable connector is used for positioning a track lighting fixture in a track lighting system. The adjustable connector releasably locks a track lighting fixture housing to an adapter. The adapter is connected to a track of the track lighting system. The adjustable connector includes an arcuate mount fixed to the track lighting fixture housing. A lock is releasably secured to the arcuate mount to secure the arcuate mount to the adapter to determine the selected position of the housing. Release of the lock allows the housing to be moved into another selected position. The lock secures the position of the lighting fixture housing relative to the track at a selected vertical position and a selected horizontal position simultaneously.

20 Claims, 3 Drawing Sheets

ADJUSTABLE CONNECTOR FOR TRACK LIGHTING FIXTURE

BACKGROUND OF THE INVENTION

Track lighting systems include a track which provides support for a track lighting fixture and a source of electric power for the track lighting fixture. Track lighting systems are often utilized in commercial establishments where individual track lighting fixtures are utilized to highlight a particular item or area. Typically, it has been found that it is both necessary and desirable to readjust the aiming of the light from a track lighting fixture in both the vertical and horizontal directions. In lighting installations where a multiplicity of track lighting fixtures have been employed, such as in a retail environment, proper aiming is important to good visual merchandising. Since it may take great time and effort to achieve a well aimed installation, it is desirable, through some mechanical means, to be able to fix or lock the track lighting fixtures to prevent the intended aim from being altered accidentally. Fixtures may be knocked out of aim by being bumped, through cleaning, or through relamping. The original aiming might be done by a skilled display designer. However, relamping and cleaning may very likely be done by someone who doesn't have the requisite skills or appreciation of the art of good lighting.

The typical construction of a track lighting system allows the track lighting fixture to be rotated relative to an adapter which connects the lighting fixture to the track. This provides an adjustment in a horizontal plane. However, it is also necessary to adjust the lighting fixture in a vertical direction. The construction heretofore utilized required that adjustment be made by loosening one or more fastening devices to allow the fixture to be moved to a selected position. The fastening devices are then tightened to lock the fixture into position.

It is desirable to provide a track lighting fixture construction wherein the lighting fixture may be adjusted both horizontally and vertically. Once the lighting fixture is its proper attitude, the lighting fixture may be locked into position in a single operation, thereby simultaneously securing the attitude of the lighting fixture in both the vertical and horizontal directions.

SUMMARY OF THE INVENTION

An adjustable connector is used for releasably securing a track lighting fixture housing to an adapter connected to a track of a track lighting system. The adjustable connector includes an arcuate mount fixed to the track lighting fixture housing. A lock is releasably secured to the arcuate mount to secure the arcuate mount to the adapter and thereby determine the selected position of the housing. Release of the lock allows the housing to be moved into another selected position of the lighting fixture to be selected. Tightening the lock secures the position of the lighting fixture housing relative to the track at a selected vertical position and a selected horizontal position simultaneously.

DESCRIPTION OF THE PREFERRED EMBODIMENT

Figure 1:
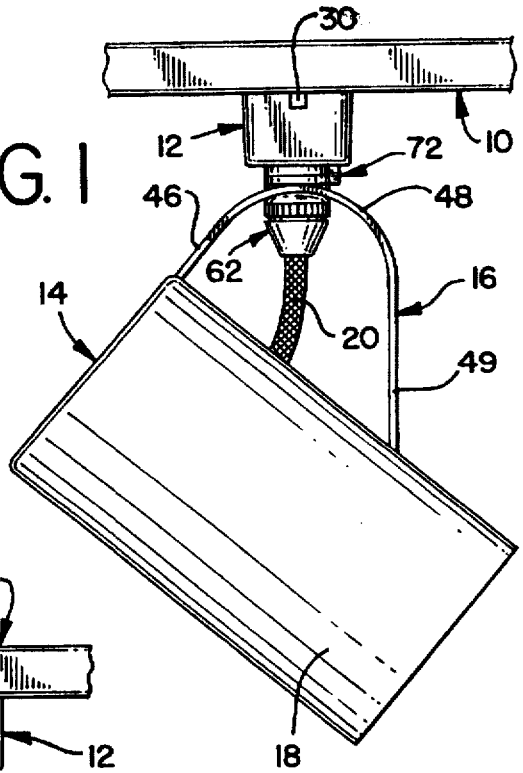
FIG. 1 is a side elevational view of a track lighting system with an adapter connected to the track and a lighting fixture housing connected to the adapter by an adjustable connector.
Figure 2:
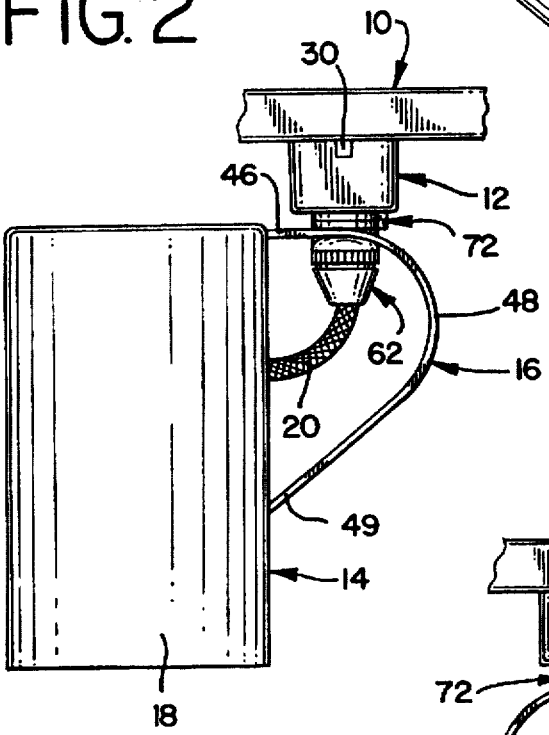
FIG. 2 is a side elevational view of a track lighting system similar to FIG. 1, but showing the lighting fixture housing in a vertical posture.
Figure 3:
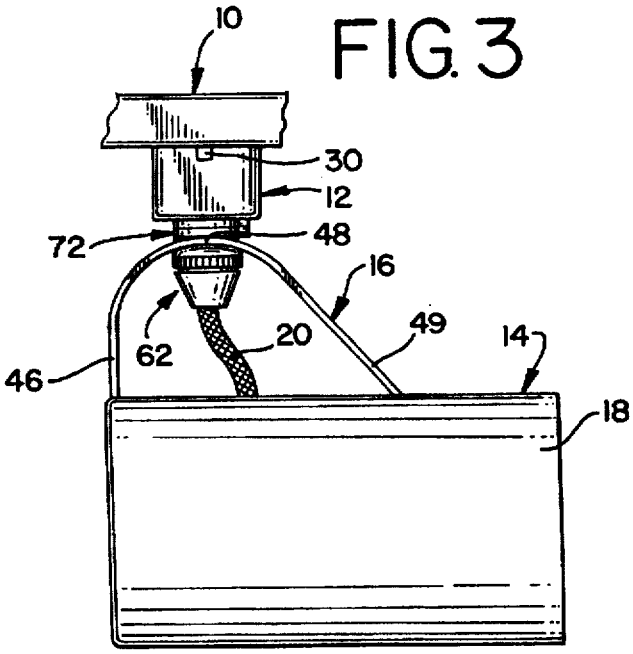
FIG. 3 is a side elevational view of a track lighting system similar to FIG. 1, but showing the lighting fixture housing in a horizontal posture.

Referring now the drawings, and especially to FIGS. 1, 2 and 3, a conventional and well known track 10 of a track lighting system is shown therein. The track is adapted for mounting on a surface, such as a ceiling, as is well know. A conventional and well known adapter 12 is mechanically and electrically connected to the track, as is conventional. A track lighting fixture 14 is a conventional track lighting fixture and is connected to adapter 12 by an adjustable connector 16. Track lighting fixture 14 includes a conventional housing 18 which has a longitudinal axis coincidental with the longitudinal axis of the lighting fixture and is parallel to the outside surface of the fixture. As is conventional, the lighting fixture includes an electrical receptacle in the housing. A lamp is mounted in the receptacle. Neither the receptacle nor the lamp is shown herein inasmuch as they are conventional and well known in the art. The lamp and receptacle are connected to the adapter through conventional wiring 20 which extends through adjustable connector 16 to adapter 12.

Figure 4:
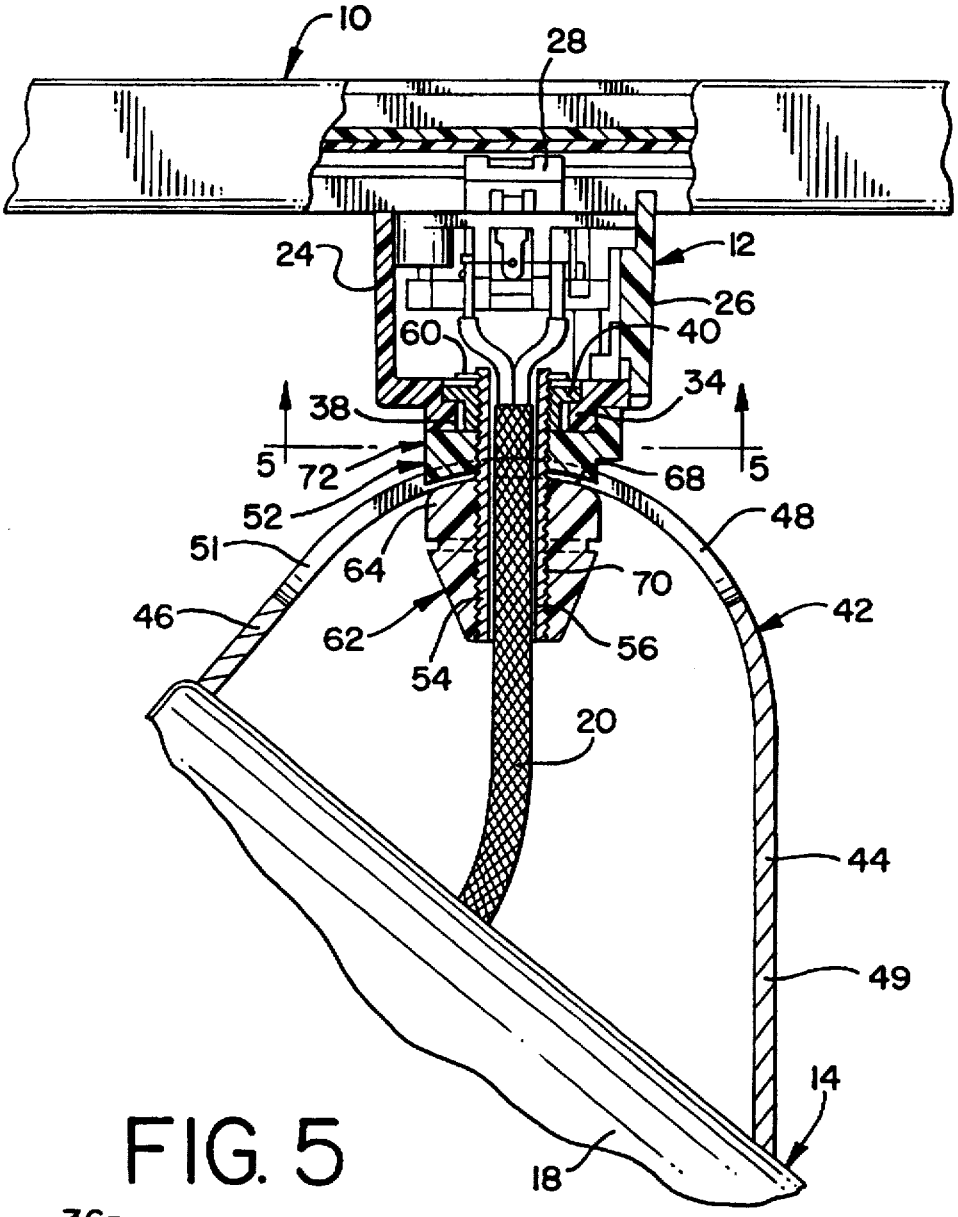
FIG. 4 is an enlarged cross sectional view of a track, an adapter connected to the track and an adjustable connector of FIG. 1.
Figure 5:
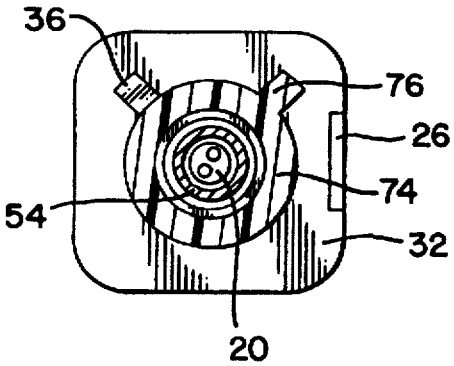
FIG. 5 is a cross sectional view taken on Line 5—5 of FIG. 4.
Figure 6:
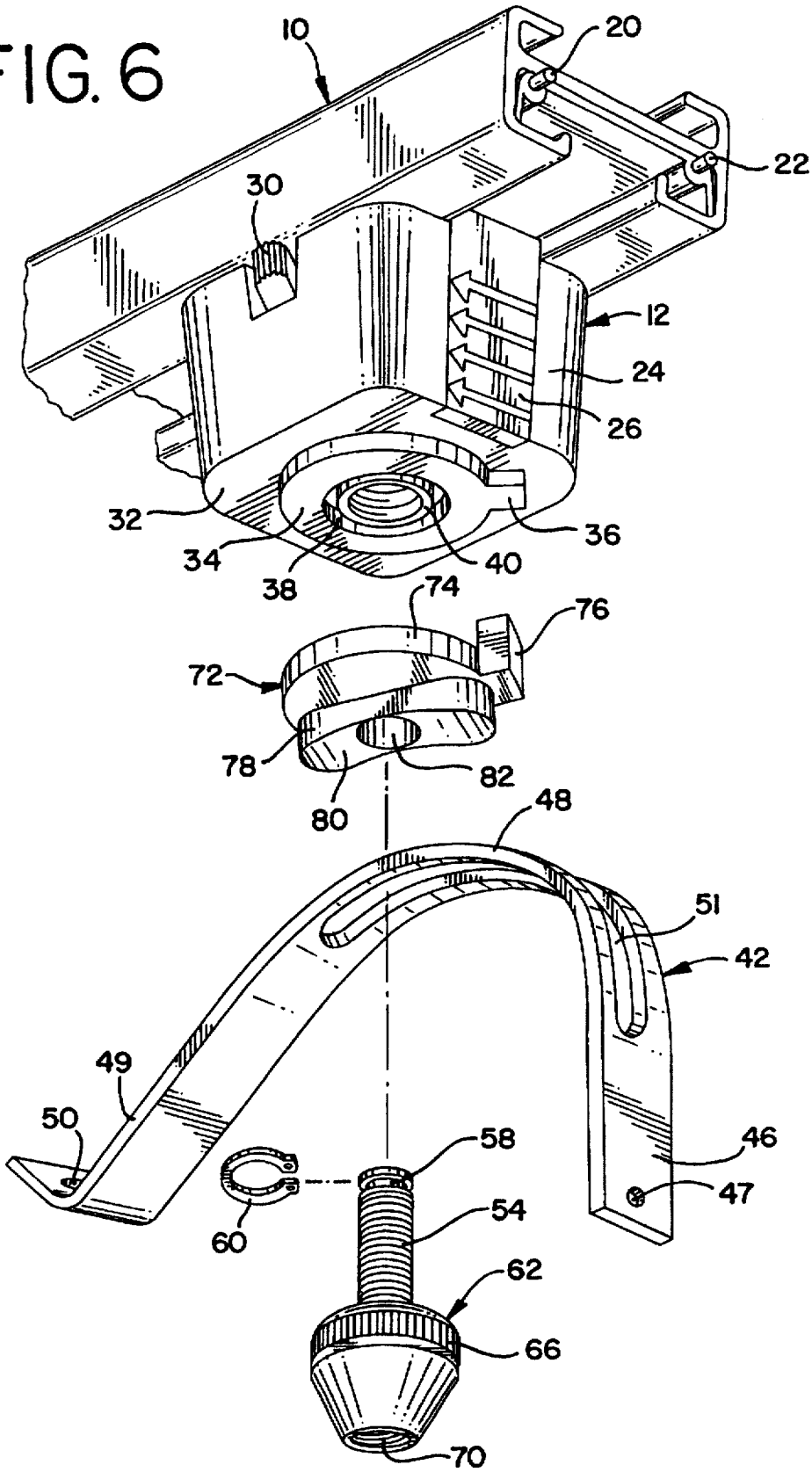
FIG. 6 is an enlarged exploded perspective view of the adjustable connector of FIG. 1 showing the adapter and a portion of the track.

As may be seen in FIG. 6, track 10 is conventional in its construction and includes a pair of electrical conductors 20 and 22. Conductors 20 and 22 are connected to a source of electric power, which source is not shown. Adapter 12 includes a conventional housing 24 with a locking tab 26 resiliently mounted therein for engagement with track 10. As is conventional, the adapter includes a pair of arms 28; one of which is shown in FIG. 4. The adapter is positioned adjacent to the track for connection thereto. The adapter is rotated so that the arms contact conductors 20 and 22 to complete an electric connection to wiring 20, and thus, to the lamp. A switch 30 is mounted in the housing to control power to the lamp.

Housing 24 includes a floor 32 with a floor ring 34 formed integral therewith. A floor stop 36 is formed integral with the floor and the floor ring. A receptacle opening 38 is formed through the floor ring and floor 32. An internally threaded receptacle 40 is non-rotatably mounted in receptacle opening 38.

The adjustable connector includes an arcuate mount 42 which has an elongated continuous flat body or longitudinal strap 44. The flat body or strap includes a perpendicular portion 46 which is perpendicular to the longitudinal axis of the lighting fixture housing. The body includes a parallel portion 48 which is parallel to the longitudinal axis of the lighting fixture housing. A sloped anchor portion 49 extends from the parallel portion 48 to the end of arcuate mount 42. The free end of the perpendicular portion 46 has a screw aperture 47 to receive a conventional screw to fix the perpendicular portion to lighting fixture housing 18. The free end of sloped anchor portion 49 has a screw aperture 50 which receives a conventional screw to fix the anchor portion to the housing. The two opposed free ends of the flat body connected to the housing by conventional screws secure the arcuate mount to the housing so that the housing and the mount move as a unit. A continuous slot 51 is formed along the length of flat body 44 from the perpendicular portion 46 through parallel portion 48, as is shown in FIGS. 4 and 6.

A releasable lock 52 is connected to adapter 12. The releasable lock includes a threaded stud 54 which has an axial wire opening 56 through which passes wire 20. The stud is threadedly mounted in internally threaded receptacle 40. The stud includes a clip groove 58 formed in the portion of the stud which extends above threaded receptacle 40, as may be seen in FIG. 4. A conventional C-clip 60 is mounted in clip groove 58 to limit movement of stud 54 out of housing 24. A knob 62 is threadedly mounted on stud 54. The knob includes a body 64 with a ribbed upper ring 66, which provides a convenient means for grasping the knob during manual rotation thereof. An engagement dome head 68 forms the upper surface of the knob. The body has a threaded axial stud aperture 70 extending through the center thereof threadedly receiving threaded stud 54.

Lock 52 also includes a guide 72 in engagement with the floor ring 34 of the adapter. Guide 72 includes a disk-like base 74 which has a circular outer periphery. Base 74 has its upper surface in engagement with the floor ring. A stop 76 is formed integral with the outer periphery of the base. Stop 76 extends upward above the surface of the base and is engageable with floor stop 36 to limit rotational movement of the guide relative to the adapter. The guide includes an integrally formed groove shoe 78 extending radially outward from the center of the guide. Groove shoe 78 has its lower surface defined by an arcuate guide surface 80 which is mateable with engagement dome head 68 of the knob. The guide includes a stud aperture 82 extending through the center thereof to receive rotatably the threaded stud 54. Groove shoe 78 is mounted in slot 51 so that the guide may not rotate relative to the arcuate mount. However, the arcuate mount with the lamp housing may move along the groove shoe through the length of slot 51 between perpendicular portion 46 and parallel portion 48 of body 44.

Lighting fixture housing 18 may be moved from a perpendicular posture wherein the longitudinal axis of the housing is perpendicular to the track, as shown in FIG. 2, to a horizontal posture wherein the longitudinal axis of the housing is parallel to the track, as shown in FIG. 3, by moving the arcuate mount along groove shoe 78. The lamp housing may be rotated relative to the adapter inasmuch as guide 72 is free to rotate relative to floor ring 34. However, the stops 36 and 76 co-act to prevent a rotation greater than 360°.

The direction of lighting from the lamp housing may be selectively adjusted vertically and horizontally. Vertically adjustment is achieved by moving the arcuate mount along the guide shoe. Horizontally adjustment is achieved by rotating the guide relative to the floor ring. The adjustment both vertically and horizontally is infinitely variable within the range of adjustment since the lock may secure the lighting fixture to the adapter at any position. Once the desired position of the direction of lighting is achieved, a simple one-hand operation locks the lighting fixture into position. Stud 54 is threadedly mounted in receptacle 40 and extends through floor 32, guide 72 and slot 51. Tightening of knob 62 on the stud causes dome 68 to engage body 44 and force the body into engagement with the guide to prevent movement along the slot, simultaneously the guide engages the floor ring to prevent rotation of the guide and the arcuate mount relative to the adapter and the track. The tightening of the knob on the stud secures the vertical position of the lighting fixture and simultaneously secures the horizontal position of the lighting fixture. There is an immediate locking of the lighting fixture in a desired position with the complete adjustment being accomplished without the use of tools of any kind.

The lighting fixture may be released to be moved into another position for changing the direction of light to another direction simply by loosening the knob which allows the arcuate mount to move relative to the groove shoe and the guide to rotate relative to the floor ring. Once the new position is achieved, the lighting fixture is quickly secured to its new position simply by turning knob 62, as described above.

Although a specific embodiment of the instant invention has been shown and described in detail hereinabove, it is readily apparent that those skilled in the art may make various modifications and changes in the disclosed construction without departing from the spirit and scope of the present invention. It is to be expressly understood that the present invention is limited only by the appended claims.

What is claimed is:

1. A lighting fixture for mounting on a track of a track lighting system comprising; a track lighting fixture housing having a longitudinal axis, an adapter connected to a track of a track lighting system, the improvement comprising; an adjustable connector releasably securing the lighting fixture housing to the adapter at a selected position, said adjustable connector including an arcuate mount connected to said lighting fixture housing, and a lock releasably securing the arcuate mount to the adapter to position and to secure selectively the lighting fixture housing relative to the track at a selected vertical position and at a selected horizontal position simultaneously.

2. A lighting fixture for mounting on a track of a track lighting system as defined in claim 1, wherein said arcuate mount includes a longitudinal strap having a perpendicular portion perpendicular to the longitudinal axis of the lighting fixture housing and a parallel portion parallel to the longitudinal axis of the lighting fixture housing.

3. A lighting fixture for mounting on a track of a track lighting system as defined in claim 1, wherein said arcuate mount includes a longitudinal strap, said strap has a continuous slot in a portion of the strap, and said lock includes a shoe slidably mounted in the slot to prevent rotation of a portion of the lock relative to the arcuate mount.

4. A lighting fixture for mounting on a track of a track lighting system as defined in claim 1, wherein said lock has a body engageable with the arcuate mount, a stud mounted in said body extending through the arcuate mount, and said adapter having an adapter housing receiving said stud to connect the light fixture housing to the adapter.

5. A lighting fixture for mounting on a track of a track lighting system as defined in claim 1, wherein said arcuate mount has an elongated slot, a guide has a shoe, said shoe movably mounted in the elongated slot, said guide has a guide stop, said adapter has an adapter housing, said adapter housing has a floor, and a floor stop connected to the floor engageable with the guide stop to limit the rotation of the arcuate mount relative to the adapter.

6. A lighting fixture for mounting on a track of a track lighting system as defined in claim 1, wherein said arcuate mount has an elongated slot, said lock includes a guide having a shoe, said shoe slidably mounted in the slot, said shoe has an arcuate face, a body has a dome head, said dome head substantially mateable with the arcuate face of the shoe, and a stud mounted in the body extending through the slot to the adapter for selectively holding the arcuate mount in a selected position relative to the adapter.

7. A lighting fixture for mounting on a track of a track lighting system as defined in claim 1, wherein the lock includes a body, said adapter has an adapter housing, said adapter housing has a receptacle opening, a threaded stud movably mounted in the body, said stud threadedly mounted in the adapter housing through the receptacle opening, and a clip mounted on the threaded stud in the adapter housing to prevent withdrawal of the stud from the adapter housing through the receptacle opening.

8. A lighting fixture for mounting on a track of a track lighting system as defined in claim 1, wherein said arcuate mount includes a longitudinal continuous strap having a perpendicular portion perpendicular to the longitudinal axis of the lighting fixture and a parallel portion parallel to the longitudinal axis of the lighting fixture, said strap has a continuous slot extending between the perpendicular portion and the parallel portion, and said lock includes a shoe slidably mounted in the slot to prevent rotation of a portion of the lock relative to the arcuate mount.

9. A lighting fixture for mounting on a track of a track lighting system as defined in claim 1, wherein said arcuate mount includes a longitudinal strap having a perpendicular portion perpendicular to the longitudinal axis of the lighting fixture and a parallel portion parallel to the longitudinal axis of the lighting fixture, said lock has a body engageable with the arcuate mount, a stud mounted in said body, said stud extends through the arcuate mount, said adapter having an adapter housing receiving said stud to connect the light fixture housing to the adapter.

10. A lighting fixture for mounting on a track of a track lighting system as defined in claim 1, wherein said arcuate mount includes a longitudinal strap having a perpendicular portion perpendicular to the longitudinal axis of the lighting fixture and a parallel portion parallel to the longitudinal axis of the lighting fixture, said strap has an elongated continuous slot extending between the perpendicular portion and the parallel portion, a guide has a shoe, said shoe movably mounted in the elongated slot, said guide has a guide stop, said adapter has an adapter housing, said adapter housing has a floor, and a floor stop connected to the floor and engageable with the guide stop to limit the rotation of the arcuate mount relative to the adapter.

11. A lighting fixture for mounting on a track of a track lighting system as defined in claim 1, wherein said arcuate mount includes a longitudinal strap having a perpendicular portion perpendicular to the longitudinal axis of the lighting fixture and a parallel portion parallel to the longitudinal axis of the lighting fixture, an elongated continuous slot formed in the longitudinal strap between the perpendicular portion and the parallel portion, said lock includes a guide has a shoe, said shoe slidably mounted in the slot, said shoe has an arcuate face, a body having a dome head, said dome head being substantially mateable with the arcuate face of the shoe, and a stud mounted in the body extending through the slot to the adapter for selectively holding the arcuate mount in a selected position relative to the adapter.

12. A lighting fixture for mounting on a track of a track lighting system as defined in claim 1, wherein the arcuate mount includes a longitudinal strap having a perpendicular portion perpendicular to the longitudinal axis of the lighting fixture and a parallel portion parallel to the longitudinal axis of the lighting fixture, said lock includes a body, said adapter has an adapter housing, said adapter housing has a receptacle opening, a threaded stud mounted in the body, said stud mounted in the adapter housing through the receptacle opening, and a clip mounted on the threaded stud in the adapter housing to prevent withdrawal of the stud from the adapter housing through the receptacle opening.

13. A lighting fixture for mounting on a track of a track lighting system as defined in claim 1, wherein said arcuate mount includes a longitudinal strap, said strap has a continuous slot in a portion of the strap, said lock includes a shoe, said shoe slidably mounted in the slot to prevent rotation of a portion of the lock relative to the arcuate mount, said lock has a body engageable with the strap, a stud mounted in the body extending through the slot, and said adapter having an adapter housing receiving the stud to connect the light fixture housing to the adapter.

14. A lighting fixture for mounting on a track of a track lighting system as defined in claim 1, wherein said arcuate mount includes a longitudinal strap, said strap has a continuous slot in a portion of the strap, said lock includes a guide having a shoe, said shoe mounted in the elongated slot, said guide has a guide stop, said adapter has an adapter housing, said adapter housing has a floor, and a floor stop connected to the floor engageable with the guide stop to limit rotation of the arcuate mount relative to the adapter.

15. A lighting fixture for mounting on a track of a track lighting system as defined in claim 1, wherein said arcuate mount includes a longitudinal strap, said strap has a continuous longitudinal slot in a portion of the strap, said lock includes a guide having a shoe, said shoe slidably mounted in the slot, said shoe has an arcuate face, a body has a dome head, said dome head being substantially mateable with the arcuate face of the shoe, and a stud mounted in the body extending through the slot to the adapter for selectively holding the arcuate mount in a selected position relative to the adapter.

16. A lighting fixture for mounting on a track of a track lighting system as defined in claim 1, wherein said arcuate mount includes a longitudinal strap, said strap has a continuous longitudinal slot in a portion of the strap, said lock includes a guide having a shoe, said shoe slidably mounted in the slot, said shoe has an arcuate face, a body has a dome head, said dome head being substantially mateable with the arcuate face of the shoe, said adapter having an adapter housing, said adapter housing having a receptacle opening, a threaded stud mounted in the body, said stud mounted in the adapter housing through the receptacle opening, and a clip mounted on the threaded stud in the adapter housing to prevent withdrawal of the stud from the adapter housing through the receptacle opening.

17. A lighting fixture for mounting on a track of a track lighting system as defined in claim 1, wherein said lock includes a body engageable with the arcuate mount, said arcuate mount has an elongated slot, said lock includes a guide having a shoe, said shoe slidably mounted in the slot, said shoe has an arcuate face, said body has a dome head, said dome head being substantially mateable with the arcuate face of the shoe, said guide has a guide stop, said adapter has an adapter housing, said adapter housing has a floor, a floor stop connected to the floor engageable with the guide stop to limit rotation of the arcuate mount relative to the adapter, and a threaded stud mounted in the body, said stud extending through the slot and mounted in the floor of the adapter housing for selectively holding the arcuate mount in a selected position relative to the adapter.

18. A lighting fixture for mounting on a track of a track lighting system as defined in claim 1, wherein said arcuate mount includes a longitudinal strap having a perpendicular portion perpendicular to the longitudinal axis of the lighting fixture and a parallel portion parallel to the longitudinal axis of the lighting fixture, said strap has a continuous slot between the perpendicular portion and the parallel portion, said lock includes a shoe, said shoe slidably mounted in the slot to prevent rotation of a portion of the lock relative to the arcuate mount, a threaded stud mounted in the body extending through the slot and mounted in the adapter, and a clip mounted on the threaded stud in the adapter to prevent withdrawal of the stud from the adapter.

19. A lighting fixture for mounting on a track of a track lighting system as defined in claim 1, wherein said arcuate mount includes a longitudinal strap having a perpendicular portion perpendicular to the longitudinal axis of the lighting fixture and a parallel portion parallel to the longitudinal axis of the lighting fixture, said strap has a longitudinal slot continuous from the perpendicular portion to the parallel portion, a guide includes a shoe, said shoe mounted in the elongated slot to prevent rotation of a portion of the lock relative to the arcuate mount, said guide has a guide stop, said adapter has an adapter housing, said adapter housing has a floor, and a floor stop connected to the floor engageable with the guide stop to limit the rotation of the arcuate mount relative to the adapter.

20. A lighting fixture for mounting on a track of a track lighting system as defined in claim 1, wherein the arcuate mount includes a longitudinal strap having a perpendicular portion perpendicular to the longitudinal axis of the lighting fixture and a parallel portion parallel to the longitudinal axis of the lighting fixture, said strap has a continuous longitudinal slot between the perpendicular portion and the parallel portion, said lock has a guide, said guide has an integral shoe mounted in the elongated slot, said guide has a guide stop, said adapter has an adapter housing, said adapter housing has a floor, a floor stop formed integral with the floor and being engageable with the guide stop to limit the rotation of the arcuate mount relative to the adapter, said shoe has an arcuate face, said lock includes a body having a dome head, said dome head being substantially mateable with the arcuate face of the shoe, a threaded stud mounted in the body, said threaded stud mounted in the floor of the adapter housing, and a clip mounted on the threaded stud in the adapter housing to prevent withdrawal of the stud from the adapter housing.

* * * * *